US010053982B2

(12) United States Patent
Raschka et al.

(10) Patent No.: US 10,053,982 B2
(45) Date of Patent: Aug. 21, 2018

(54) MILLING DEVICE

(71) Applicant: Caterpillar Global Mining Europe GmbH, Lünen (DE)

(72) Inventors: Joachim Raschka, Bochum (DE); Jens Steinberg, Lünen (DE); Ulrich Bechem, Hagan (DE)

(73) Assignee: Caterpillar Global Mining Europe GmbH, Lunen (DE)

( * ) Notice: Subject to any disclaimer, the term of this patent is extended or adjusted under 35 U.S.C. 154(b) by 141 days.

(21) Appl. No.: 14/890,234

(22) PCT Filed: May 9, 2014

(86) PCT No.: PCT/EP2014/001251
§ 371 (c)(1),
(2) Date: Nov. 10, 2015

(87) PCT Pub. No.: WO2014/183855
PCT Pub. Date: Nov. 20, 2014

(65) Prior Publication Data

US 2016/0084082 A1 Mar. 24, 2016

(30) Foreign Application Priority Data

May 13, 2013 (EP) ..... 13167551

(51) Int. Cl.
*E21C 27/22* (2006.01)
*E21C 31/02* (2006.01)
(Continued)

(52) U.S. Cl.
CPC ..... *E21C 25/08* (2013.01); *E01C 23/088* (2013.01); *E01C 23/09* (2013.01); *E21C 25/10* (2013.01);
(Continued)

(58) Field of Classification Search
CPC ..... E21C 25/08; E21C 31/02; E21C 27/22; E21C 27/24; E21C 25/10
(Continued)

(56) References Cited

U.S. PATENT DOCUMENTS 3,288,533 A 11/1966 Gonski
3,290,094 A 12/1966 Gonski
(Continued)

FOREIGN PATENT DOCUMENTS

CN 101368362 2/2009
CN 201902208 7/2011
(Continued)

OTHER PUBLICATIONS

International Search Report dated Apr. 5, 2015, in Patent Application No. PCT/EP2014/001251 by the European Patent Office (3 pages).
(Continued)

*Primary Examiner* — David J Bagnell
*Assistant Examiner* — Michael A Goodwin

(57) ABSTRACT

A milling device is disclosed. The milling device may have a shaft. The shaft may have a shaft axis (A). The milling device may also have a spindle drum rotatably mounted relative to the shaft axis (A) and rotatable about a spindle drum axis (B) coaxial to the shaft axis (A). Further, the milling device may have a plurality of tool spindles rotatably mounted in the spindle drum and rotatable about tool spindle axes (D). Each tool spindle axis (D) may be parallely arranged and spaced apart from the shaft axis (A) and may have a same distance to the shaft axis (A). The milling machine may also have a plurality of machining tools carried by the tool spindles. At least two of the plurality of machining tools may be positioned displaced from one another in a direction of the shaft axis (A).

19 Claims, 10 Drawing Sheets

(51) Int. Cl.

| | |
|---|---|
| ***E21C 25/08*** | (2006.01) |
| ***E01C 23/09*** | (2006.01) |
| ***E21D 9/10*** | (2006.01) |
| ***E01C 23/088*** | (2006.01) |
| ***E21C 25/10*** | (2006.01) |

(52) U.S. Cl.
CPC ..... *E21C 27/22* (2013.01); *E21C 31/02* (2013.01); *E21D 9/1013* (2013.01)

(58) Field of Classification Search
USPC ..... 299/85.1
See application file for complete search history.

(56) References Cited

U.S. PATENT DOCUMENTS

| | | | | |
|---|---|---|---|---|
| 3,362,753 | A | 1/1968 | Sibley | |
| 3,412,816 | A * | 11/1968 | Lautsch | E21B 10/28 175/106 |
| 3,663,062 | A | 5/1972 | Young et al. | |
| 3,945,445 | A | 3/1976 | Ikeda | |
| 4,371,210 | A * | 2/1983 | Leibee | B28D 1/181 175/338 |
| 4,627,501 | A * | 12/1986 | Ebeling | E21B 4/006 175/319 |
| 7,490,911 | B2 * | 2/2009 | Steinberg | E21C 27/22 299/71 |
| 7,631,942 | B2 | 12/2009 | Bechem et al. | |
| 7,896,445 | B2 | 3/2011 | Bechem | |
| 8,262,168 | B2 | 9/2012 | Hall et al. | |
| 2004/0172857 | A1 * | 9/2004 | Deniau | E02F 3/205 37/91 |
| 2007/0193810 | A1 | 8/2007 | Steinberg et al. | |
| 2008/0116734 | A1 * | 5/2008 | Bechem | E21C 27/22 299/10 |

FOREIGN PATENT DOCUMENTS

| | | |
|---|---|---|
| CN | 103075153 | 5/2013 |
| DE | 288984 C | 5/1915 |
| DE | 10 2005 028277 A1 | 12/2006 |
| EP | 2057348 | 11/2012 |
| GB | 957716 | 5/1964 |
| GB | 1011783 | 12/1965 |
| GB | 1195571 | 6/1970 |
| JP | 60105717 | 6/1985 |
| RU | 2330955 C1 | 8/2008 |
| WO | WO 2006/079536 A1 | 8/2006 |

OTHER PUBLICATIONS

European Search Report dated Oct. 31, 2013, in Patent Application No. EP 13 16 7551 (2 pages).

* cited by examiner

MILLING DEVICE

CLAIM FOR PRIORITY

This application is a U.S. National Phase entry under 35 U.S.C. § 371 from PCT International Application No. PCT/EP2014/001251, filed May 9, 2014, which claims benefit of priority of European Patent Application No. 13167551.4, filed May 13, 2013, all of which are incorporated herein by reference.

Technical Field

The present disclosure relates to a milling device, and more particularly to a milling device comprising a plurality of machining tools.

BACKGROUND

In the field of underground or open-work mining as well as in road or structural engineering, several milling systems are known for the milling of rock and other hard materials such as extraction products, tarmac, and concrete components. For such milling operations, rotary driven drums or discs including milling tools mounted at the circumference thereof in an evenly distributed manner are mainly used. As an example, round shaft bits may be used as milling tools. During the milling operation, milling tools successively wear until they have to be replaced. Wear of milling tools is even increased in milling of hard materials.

Due to costly replacements of worn cutting tools, extending the service life of milling tools is subject of ongoing interest for milling system manufactures.

One approach in reducing the wear rate of milling systems aims on reducing the cutting time of each individual milling tool. For example, by providing a plurality of individual milling tools, each being in milling operation for only a short time span, the wear rate of each milling tool may be reduced as heat peaks which considerably increase wear may be reduced.

As an example, WO 2006/079536 A1 discloses a device for milling treatment. The device includes a spindle drum which is rotatably mounted on a drum support and rotatable about a drum axis. In the spindle drum, several tool spindles are supported eccentrically to the drum axis to be rotatably driveable about spindle axes. Each tool spindle carries a machining tool at its end projecting from the spindle drum.

As a further example, DE 288 984 C discloses a shearer including two rotatable discs. On both sides of each disc, a plurality of cutting cylinders is provided.

The present disclosure is directed, at least in part, to improving or overcoming one or more aspects of prior systems.

SUMMARY OF THE DISCLOSURE

According to a first aspect of the present disclosure, a milling device may comprise a shaft having a shaft axis, a spindle drum rotatably mounted relative to the shaft axis and rotatable about a spindle drum axis coaxial to the shaft axis, a plurality of tool spindles rotatably mounted in the spindle drum and rotatable about tool spindle axes, each tool spindle axis being parallely arranged spaced apart from the shaft axis and having the same distance to the shaft axis, and a plurality of machining tools carried by the tool spindles, at least two of the plurality of machining tools being positioned displaced from one another in the direction of the shaft axis.

According to a second aspect of the present disclosure, a milling machine may be configured to be used in milling applications for milling coal, concrete, tarmac and/or other extraction products and materials. The milling machine may comprise a milling device as exemplary disclosed herein.

Other features and aspects of this disclosure will be apparent from the following description and the accompanying drawings.

DETAILED DESCRIPTION

Figure 1:
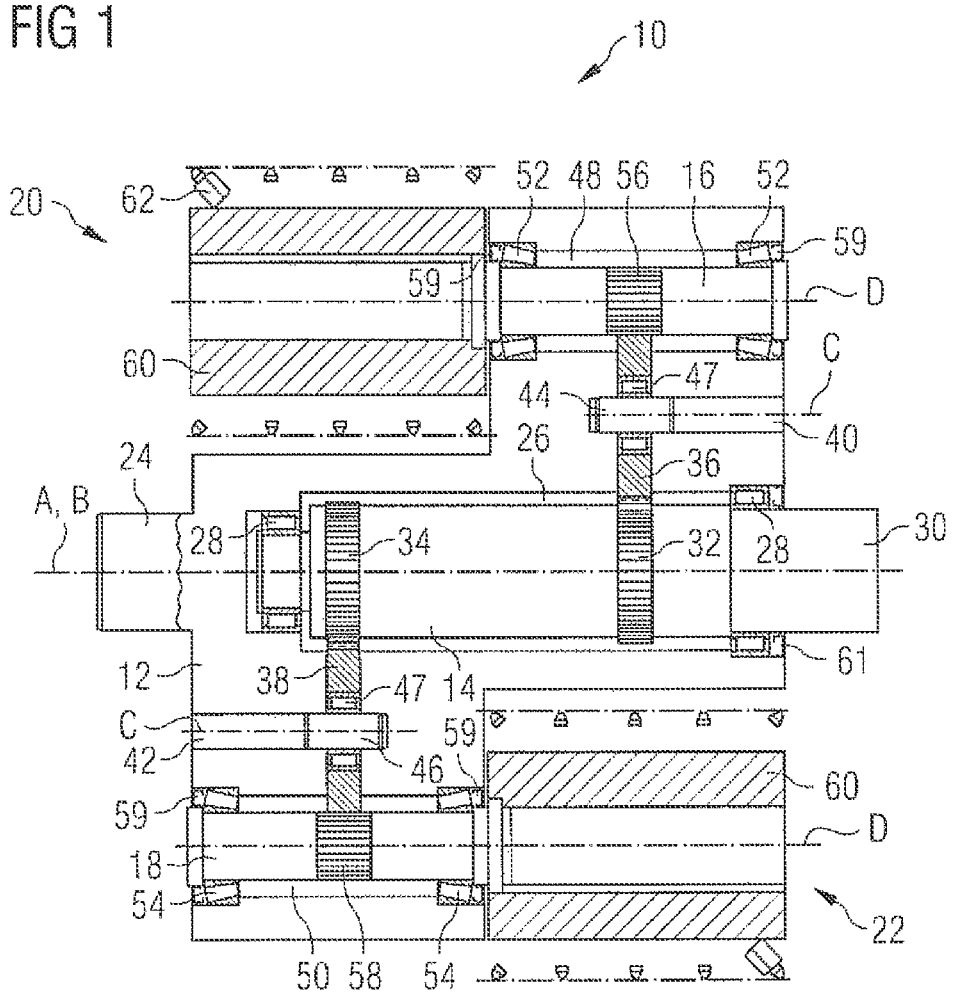
FIG. 1 shows a sectional view of a first embodiment of a milling device according to the present disclosure.

The following is a detailed description of exemplary embodiments of the present disclosure. The exemplary embodiments described therein and illustrated in the drawings are intended to teach the principles of the present disclosure, enabling those of ordinary skill in the art to implement and use the present disclosure in many different environments and for several different applications. Therefore, the exemplary embodiments are not intended to be, and should not be considered as, a limiting description of the scope of patent protection. Rather, the scope of patent protection shall be defined by the appended claims.

The present disclosure is based in part on the realization that the practical application field of milling devices with rotatable spindle drums and a plurality of rotatable machining tools rotatably mounted in the spindle drum can be extended, for example, to road mills continuous miners, and surface miners if one manages to considerably increase the realizable cutting depth and cutting width of the milling device in the application specific cutting methods.

Accordingly, a milling device is disclosed which facilitates comparatively deep and wide cuts in the material to be milled while maintaining the underlying principle of the milling device including the plurality of machining tools to keep the inherent advantages of the milling device, which are, for example, comparatively short cutting times of each individual tool resulting in low temperatures of the tools leading to a decreased wear of the tools.

Figure 2:
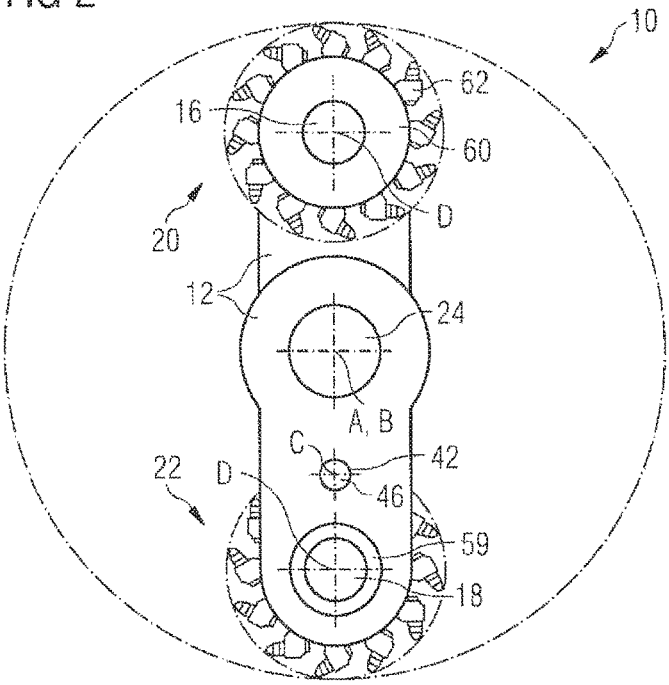
FIG. 2 shows a plan view on a spindle drum of the first embodiment of the milling device shown in FIG. 1.

Referring to FIGS. 1 and 2, an exemplary milling device is referenced in its entirety with reference numeral 10.

Milling device 10 comprises a spindle drum 12, a shaft 14, tool spindles 16, 18, and machining tools 20, 22.

Spindle drum 12 is rotatable about a spindle drum axis B. For rotating spindle drum 12 and holding the same, a first end 24 of spindle drum 12 can be coupled to a rotary drive of a tool holder such as an arm of a road milling machine or a continuous miner, not shown in detail. For the fixing to a machine frame, additional mounting mechanisms not shown in detail may be provided.

A central shaft reception 26 is provided in spindle drum 12 to accommodate a shaft 14, which is mounted in central shaft reception 26 along a shaft axis A in a rotary manner with two cylinder roller bearings 28. At a second end 30, shaft 14 is also coupled to another rotary drive of another tool holder such as an arm of the road milling machine or the continuous miner, again not shown in detail. Due to the coupling to a rotary drive, shaft 14 is rotatable about shaft axis A. Alternatively, shaft 14 may be not rotatable. In both cases, shaft axis A and spindle drum axis B are coaxially arranged.

Shaft 14 includes a first shaft gear wheel 32 and a second shaft gear wheel 34 meshing with planetary gear wheels 36 and 38, respectively. Both first planetary gear wheel 36 and second planetary gear wheel 38 are rotatably mounted relative to spindle drum 12 and shaft 14. Specifically, spindle drum 12 includes planetary gear shaft bores 40, 42 for accommodating planetary gear bolts 44, 46 which are fixedly mounted therein. As first planetary gear wheel 36 is coupled to planetary gear bolt 44 within first planetary gear shaft bore 40 via a cylinder roller bearing 47, planetary gear wheel 36 is rotatable about a respective planetary gear wheel axis C which is parallely arranged spaced apart from shaft axis A and spindle drum axis B. Similarly, second planetary gear wheel 36 is rotatable about a respective planetary gear wheel axis C due to the presence of another cylinder roller bearing 47 supporting second planetary gear wheel 38 on second gear wheel bolt 46 within second planetary gear shaft bore 42 of spindle drum 12. First and second planetary gear wheel 36 and 38 are positioned displaced from one another in the direction of shaft axis A. Alternatively to planetary gear wheels 36 and 38, chains or belts may be provided.

In an outer circumferential region, spindle drum 12 further comprises tool spindle receptions 48 and 50, both being positioned displaced from one another in the direction of shaft axis A.

In first tool spindle reception 48, a first tool spindle 16 is mounted in a rotary manner with two taper roller bearings 52 in a back-to-back arrangement such that first tool spindle 16 is rotatable about a respective tool spindle axis D. Said tool spindle axis D is parallely arranged spaced apart from shaft axis A, spindle drum axis B, and planetary gear wheel axes C. Likewise, a second tool spindle 18 is rotatably mounted in second tool spindle reception 50 via another two taper roller bearings 54 in a back-to-back arrangement facilitating rotation of second tool spindle 18 about a respective tool spindle axis D. Each tool spindle axis D is parallely arranged spaced apart from the shaft axis A in the same distance. In other words, tool spindle axes D are parallely arranged spaced apart from the shaft axis A on a circle around shaft axis A. Tool spindles 16 and 18 are provided with first and second driven gear wheels 56 and 58 meshing with planetary gear wheels 36 and 38, respectively.

To reduce ingress of dirt and cuffed material into tool spindle receptions 48 and 50, shaft seals 59 may be provided, for example, adjacent to taper roller bearings 52 in openings of tool spindle receptions 48 and 50 in spindle drum 12. Likewise, shaft seal 61 may be provided to reduce particle ingress through an opening of central shaft reception 26 in spindle drum 12.

In some embodiments, spindle tool receptions may receive bearing bushes with a tool spindle rotatably mounted therein. Specifically, bearing bushes with tool spindles mounted therein like a cartridge are inserted into a respective drum chamber in an exchangeable manner and may be locked, for example, by a plurality of screws. Such an arrangement may ease exchange of worn or damaged tool spindles and machining tools.

In the embodiment shown in FIGS. 1 and 2, each tool spindle 16, 18 carries a machining tool 20, 22 at an outer end thereof. Machining tools 20, 22 project from spindle drum 12 in the direction of tool spindle axes D.

Both first and second machining tool 20, 22 are exemplary embodied as end milling cutters including a support shaft 60 that is rigidly connected to a respective tool spindle 16 and 18. In particular, support shaft 60 of first machining tool 20 is rigidly connected to an outer end of first tool spindle 16, whereas support shaft 60 of second machining tool 22 is rigidly connected to an outer end of second tool spindle 18.

A plurality of individual tools 62 is arranged at an outer circumference of each machining tool 20, 22. For example, individual tools 62 consist of straight round shank chisels (chisel bits) arranged in a spiral form over the length of support shaft 60. For clarification, only one of the plurality of individual tools 62 is shown in detail, the remaining being only indicated in the drawings by their tips.

In some embodiments, machining tools 20, 22 may be differently embodied. For example, machining tools may be embodied as chisel rings with impact chisels, chisel milling cutters, or cutting discs.

As can be clearly seen, both first and second machining tool 20, 22 are positioned displaced from one another in the direction of shaft axis A. Specifically, first machining tool 20 and second machining tool 22 are displaced from one another for about an axial length of each machining tool 20, 22, which defines a cutting width of the respective machining tool 20, 22. Moreover, first machining tool 20 and second tool spindle reception 50 are positioned overlapping with one another in the direction of shaft axis A. In other words, first machining tool 20 and second tool spindle reception 50 extend substantially within the same longitudinal section of milling device 10 along shaft axis A. As a result, in the shown embodiment, if rotating spindle drum 12 through 180° about spindle axes B, first machining tool 20 would be located at the former location of second tool spindle reception 50, and vice versa. Likewise, if rotating spindle drum 12 through 180° about spindle axes B, second machining tool 22 would be located at the former location of first tool spindle reception 48, and vice versa.

In some embodiments, at least one first machining tool 20 and at least one second machining tool 22 may be positioned partially overlapping with one another in the direction of shaft axis A. Additionally, at least one first tool spindle reception 48 may be positioned displaced from at least one second tool spindle reception 50 in the direction of shaft axis A.

In some embodiments, at least one first machining tool 20 and at least one second machining tool 22 may be positioned displaced from one another such that basically no overlapping with one another in the direction of shaft axis A is provided.

In some embodiments, at least one first machining tool 20 and at least one second tool spindle reception 50 are positioned overlapping with one another in the direction of shaft axis A. Additionally or alternatively, at least one second machining tool 22 and at least one first tool spindle reception 48 may be positioned overlapping with one another in the direction of shaft axis A.

In some embodiments, spindle drum 12 may have an overall length along spindle drum axis A of up to 5 m, for example, 2 m, 3 m, or 4 m. A diameter of spindle drum 12 may be within a range from 500 mm to 1500 mm.

A gear ratio between tool spindles 16, 18 and spindle drum 12, may be within a range from 5 to 20. For example, a gear ratio of 5 may be chosen in applications in which a diameter of spindle drum 12 is about 500 mm, and a gear ratio of 20 may be chosen in applications in which a diameter of spindle drum 12 is about 1500 mm. As an example, spindle drum 12 may be rotated with a rotational speed of 50 revolutions per minute. Assuming the gear ratio between tool spindles 16, 18 and spindle drum 12 may be 10, tool spindles 16 and 18 would rotate with a rotational speed of 500 revolutions per minute.

In the following, further embodiments of the milling device are described with a focus on the differences to the first embodiment described above. For ease of comparison, similar components will be referred to with same reference numerals in the respective "X00" series, the "X" referring to the specific embodiment.

Figure 3:
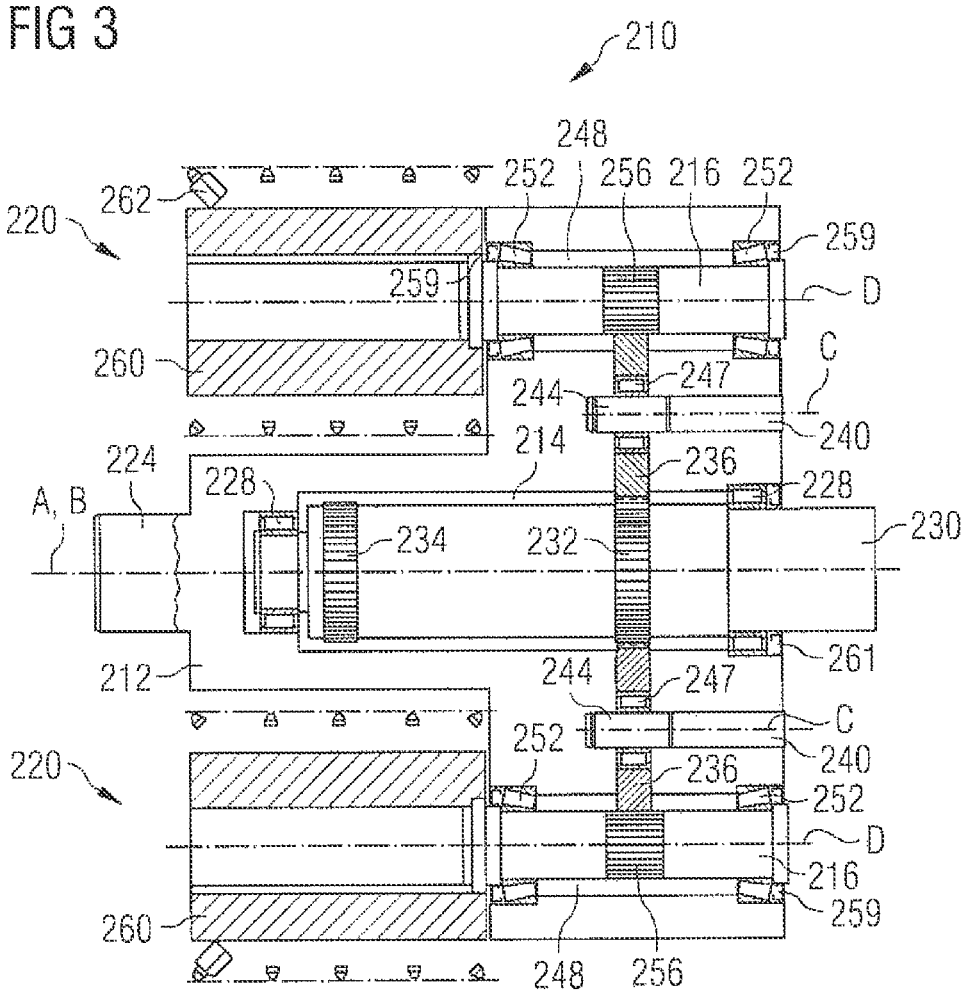
FIG. 3 shows a sectional view of a second embodiment of the milling device according to the present disclosure.
Figure 4:
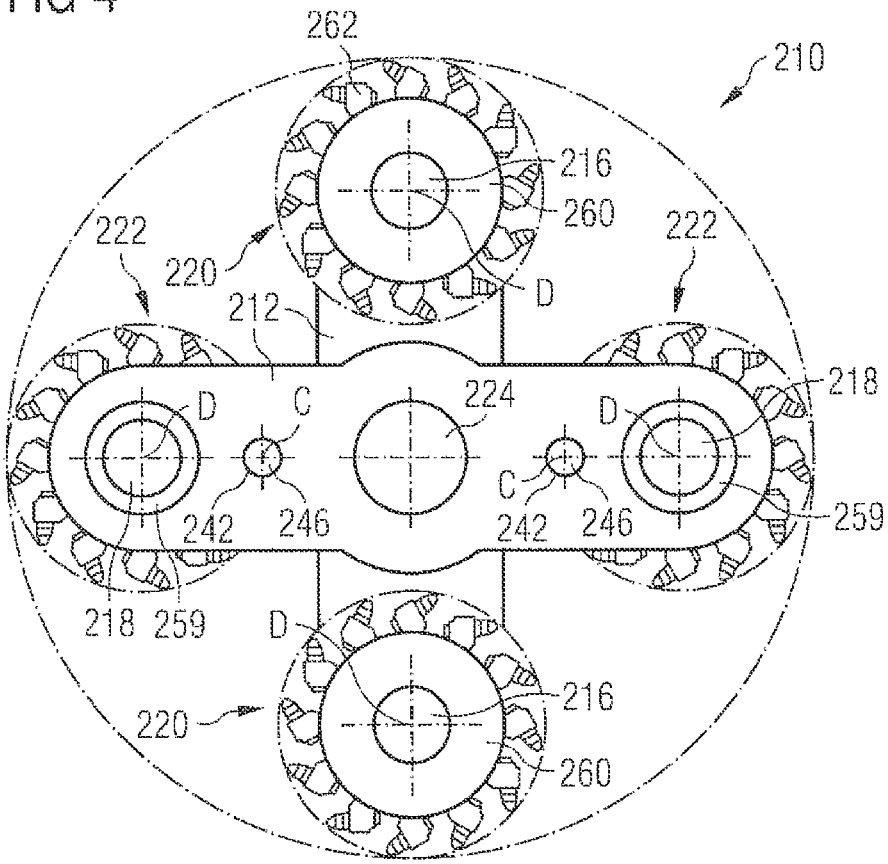
FIG. 4 shows a plan view on a spindle drum of the second embodiment of the milling device shown in FIG. 3.

Referring now to FIGS. 3 and 4, a second embodiment of milling device is indicated with reference numeral 210. The second embodiment particularly comprises two additional machining tools in comparison to the first embodiment shown in FIGS. 1 and 2.

The depicted embodiment of milling device 210 comprises two first machining tools 220 and two second machining tools 222. The two first machining tools 220 are carried by two first tool spindles 216 rotatably mounted in two first tool spindle receptions 248, whereas the two second machining tools 222 are carried by two second tool spindles 218 (see FIG. 4) rotatably mounted in two second tool spindle receptions 250 (not visible in FIGS. 3 and 4).

Both first machining tools 220 are positioned overlapping with one another and with second tool spindle reception 250 in the direction of shaft axis A. Additionally, both first machining tools 220 are arranged equidistantly to one another in a circumferential direction around shaft axis A. In the shown embodiment, first machining tools 220 are displaced from one another around shaft axis A by 180° in a circumferential direction. In other embodiments with further first machining tools, the plurality of first machining tools may be provided such that neighbouring first machining tools are arranged equidistantly to one another in a circumferential direction around shaft axis A. Alternatively, neighbouring first machining tools may be not arranged equidistantly in a circumferential direction around shaft axis A.

Moreover, both second machining tools 222 are positioned overlapping with one another and with first tool spindle reception 248 in the direction of shaft axis A. Further, both second machining tools 222 are displaced from one another around shaft axis A by 180° in a circumferential direction. In other embodiments with further second machining tools, the plurality of second machining tools may be provided such that neighbouring second machining tools are arranged equidistantly to one another in a circumferential direction around shaft axis A. Alternatively, neighbouring second machining tools may be not arranged equidistantly in a circumferential direction around shaft axis A.

Note that first shaft gear wheel 232 and second shaft gear wheel 234 each mesh with two planetary gear wheels. For example, first shaft gear wheel 232 of shaft 214 meshes with two first planetary gear wheels 236. In other embodiments, an individual shaft gear wheel may even mesh with three or more planetary gear wheels, each planetary gear wheel in turn meshing with a respective tool spindle carrying at least on machining tool.

Figure 5:
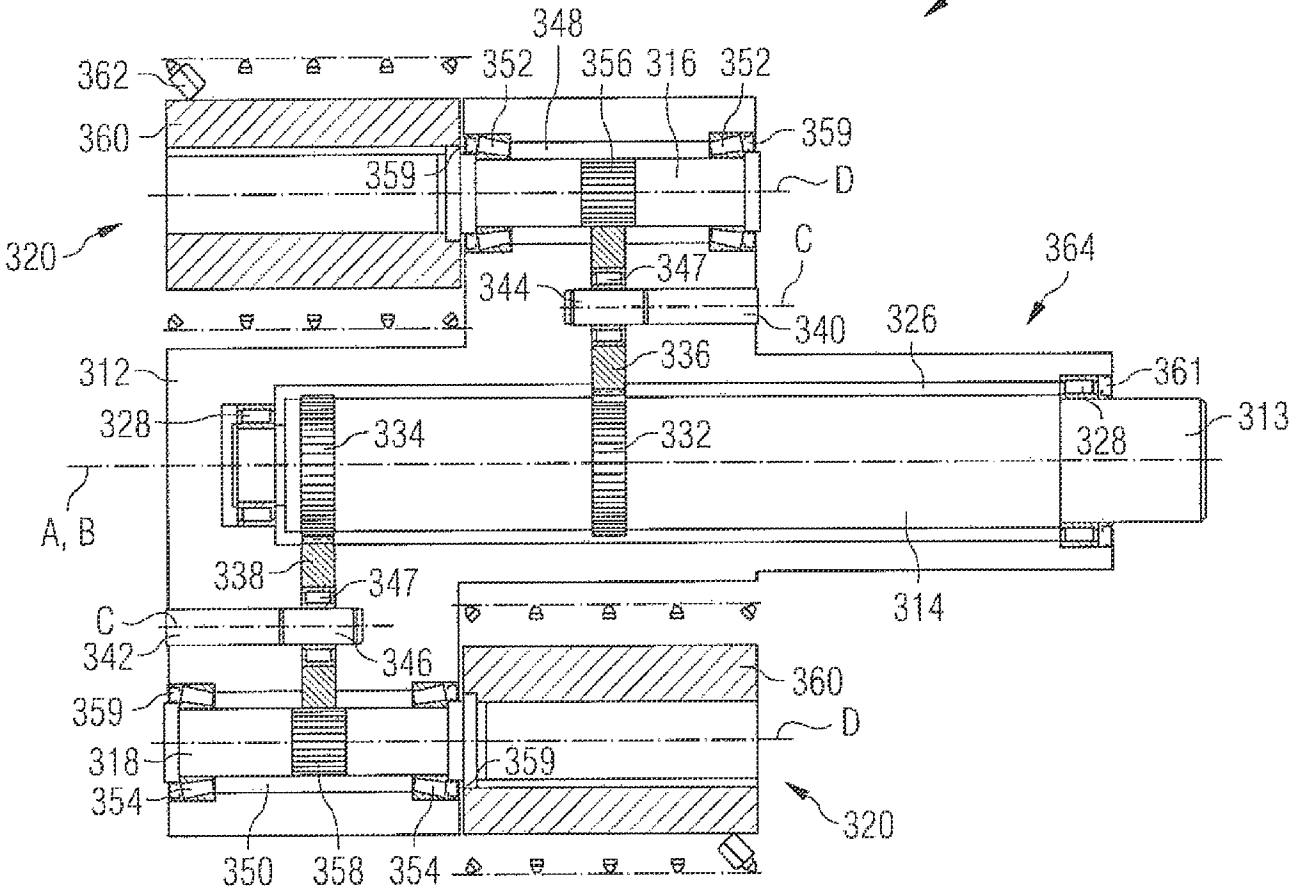
FIG. 5 shows a sectional view of a third embodiment of a milling device according to the present disclosure.

Turning to FIG. 5, a third embodiment of a milling device is referenced with reference numeral 310. Milling device 310 comprises an elongated spindle drum section 364. Elongated spindle drum section 364 of spindle drum 312 may facilitate coupling to a rotary drive of a tool holder, instead of coupling spindle drum 12 to a rotary drive via a first end 24 as in the first embodiment shown in FIGS. 1 and 2.

Figure 6:
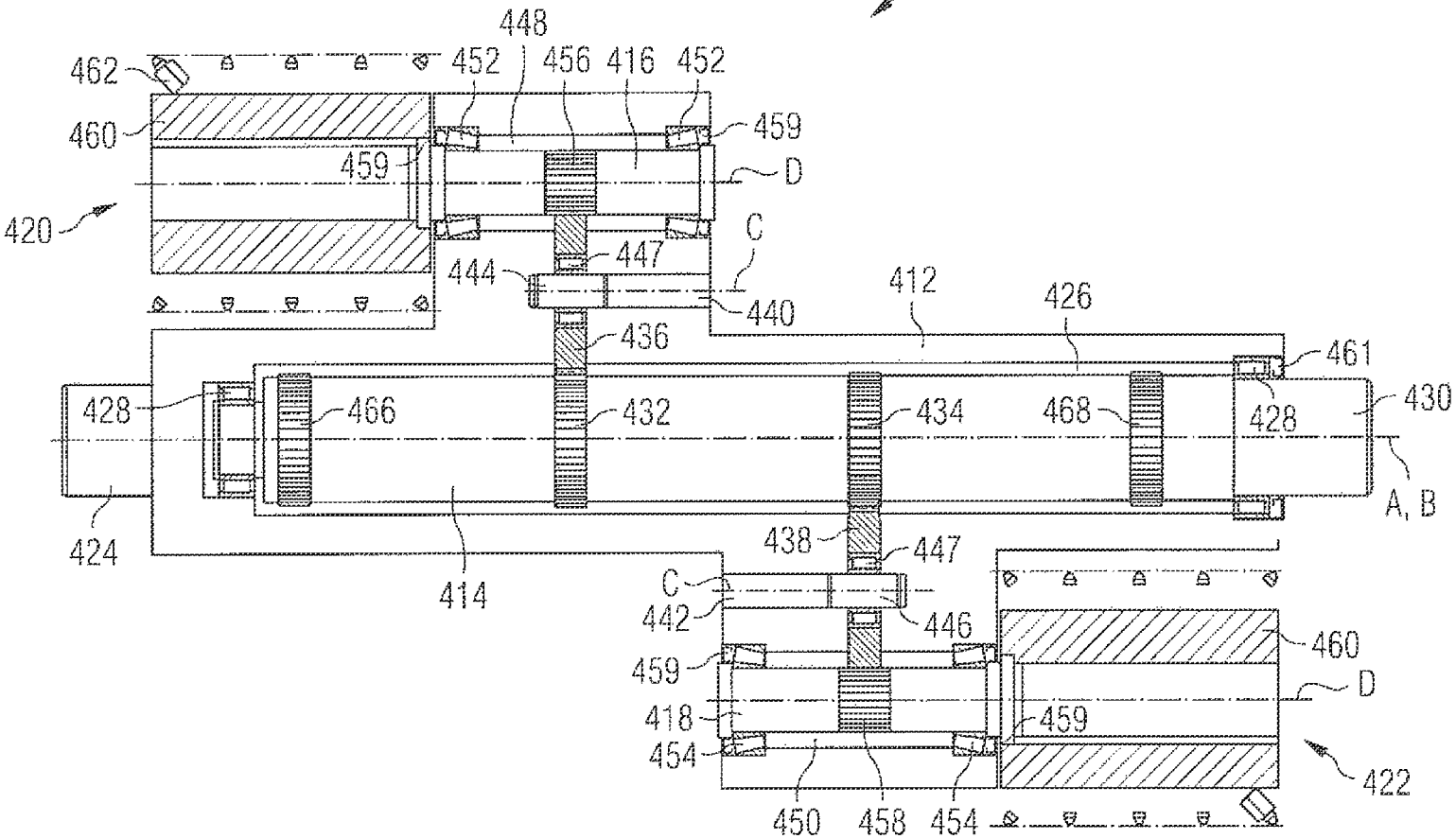
FIG. 6 shows a sectional view of a fourth embodiment of a milling device according to the present disclosure.

With respect to FIG. 6, a fourth embodiment of a milling device is indicated by reference numeral 410. Milling device 410 comprises four machining tools (note that only two machining tools are visible). Each machining tool is positioned displaced from the others in direction of shaft axis A and in circumferential direction around shaft axis A.

In addition to a first shaft gear wheel 432 and a second shaft gear wheel 434, a third shaft gear wheel 466 and a fourth shaft gear wheel 468 are provided. Third shaft gear wheel 466 and fourth shaft gear wheel 468 mesh with respective planetary gear wheels which in turn mesh with respective tool spindles that carry the third machining tool and the fourth machining tool, respectively (due to the chosen view in FIG. 5 not visible).

Each of said four machining tools is positioned displaced from its neighboring machining tools in a circumferential direction around shaft A by 90°, which constitutes an equidistant arrangement of the four machining tools in the circumferential direction around shaft axis A. Further, neighboring machining tools in a direction along shaft axis A are also equidistantly displaced in the shown embodiment. In other embodiments, neighboring machining tools may be not equidistantly arranged in circumferential direction around shaft axis A and/or in direction along shaft axis A.

In some embodiments, a milling device may comprise a plurality of at least one n-th machining tool. Each at least n-th machining tool is displaced from one another in the direction of shaft axis A. For example, a milling device may comprise nine machining tools. Every three machining tools may be positioned overlapping with one another in the direction of the shaft axis, and may be positioned displaced from the remaining machining tools in the direction of shaft axis A. Each of the every three machining tools may be further displaced from one another in a direction around the shaft axis by 120°.

Figure 7:
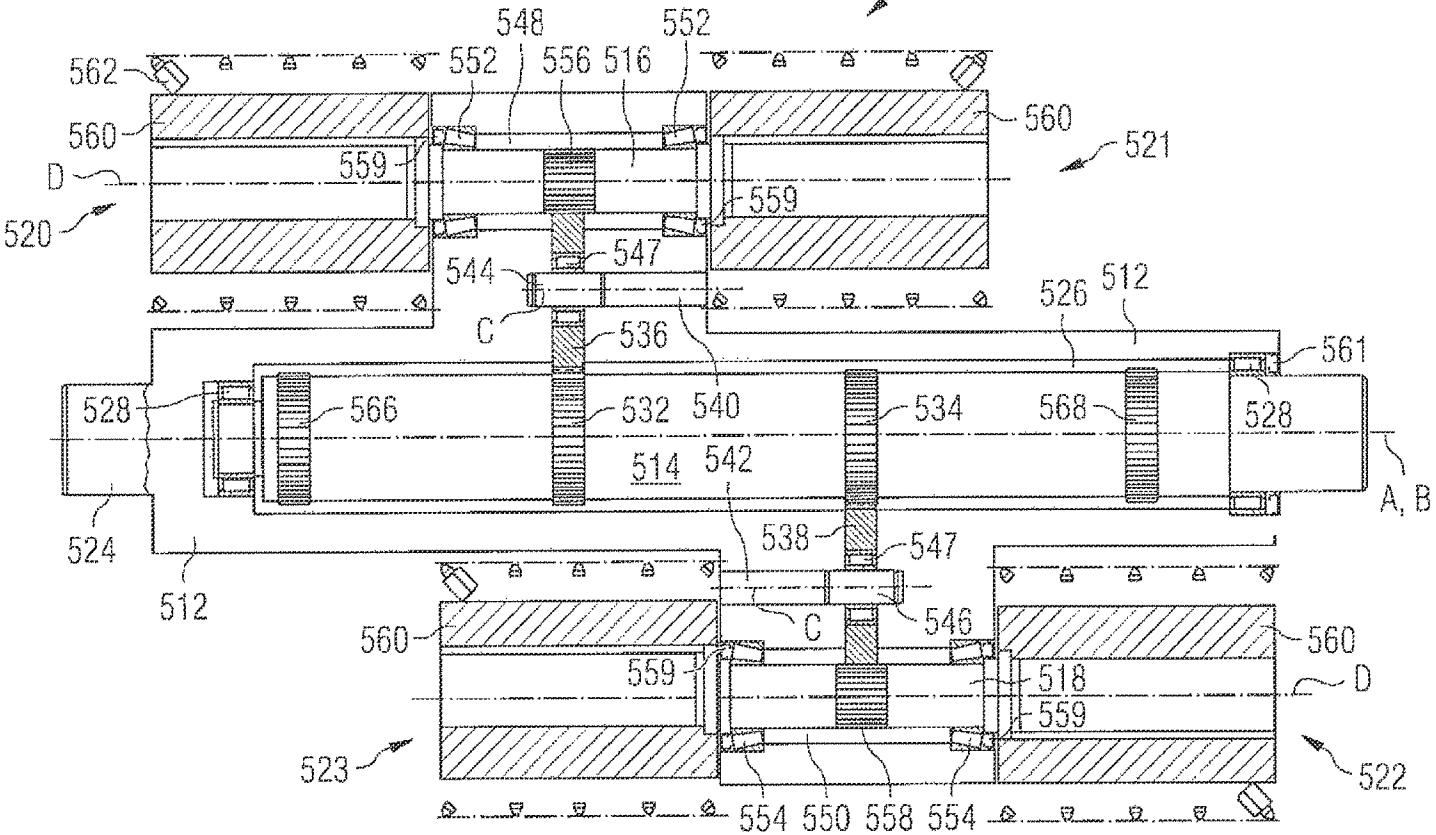
FIG. 7 shows a sectional view of a fifth embodiment of a milling device according to the present disclosure.

As a further example, a fifth embodiment of milling device is depicted in FIG. 7 and referenced in its entirety with reference numeral 510. Here, milling device 510 comprises tool spindles which can carry two machining tools. For example, a first tool spindle 516 carries a first machining tool 520 and a third machining tool 521 at opposing spindle shaft ends extending out of openings of a first tool spindle reception 548 in a spindle drum 512.

Similar to the fourth embodiment described in connection with FIG. 6, further not visible machining tools are provided at milling device 510, their presence being indicated by a third and fourth shaft gear wheel 566 and 568.

Figure 8:
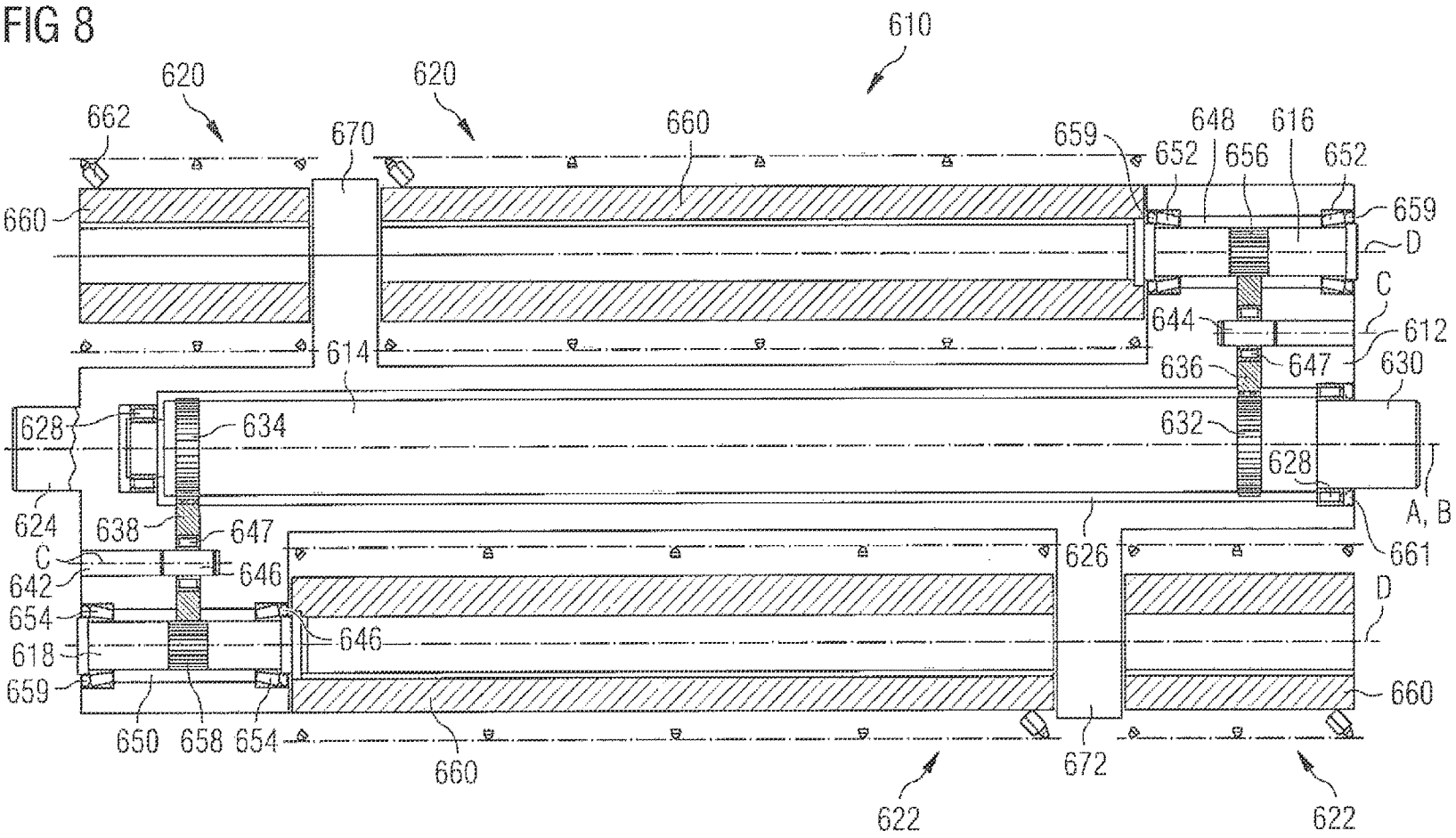
FIG. 8 shows a sectional view of a sixth embodiment of a milling device according to the present disclosure.

Turning to FIG. 8, an embodiment of a milling device is shown which comprises comparatively long machining tools and tool spindles for facilitating comparatively long cutting widths.

Both first machining tool 620 and second machining tool 622 include two separate sections, each section being equipped with a plurality of individual cutting tools 662.

Tool spindles 616 and 618 are not only rotatably mounted in tool spindle receptions 648 and 650, but also in projections 670 and 672 of spindle drum 612 due to the long axial length of tool spindles 616, 618. Within each projection 670 and 672, a floating bearing (not shown) is arranged. Said floating bearings may be, for example, cylinder roller bearings which are particularly suitable for the reception of large radial forces that may occur due to the extended axial length of tool spindles 616, 618.

INDUSTRIAL APPLICABILITY

In the following, the operation of exemplary disclosed milling device 10 is described. Thereafter, milling device 10 is compared with a known milling device.

Representative for all embodiments, operation of the first embodiment of the milling device (see FIGS. 1 and 2) according to the present disclosure is described.

During operation, spindle drum 12 is rotated around spindle axis B and machining tools 20 and 22 are rotated around tool spindle axes D due to rotation of tool spindles 16 and 18. Rotation of tool spindles 16 and 18 may be solely caused by rotation of spindle drum 12 in embodiments in which shaft 14 is not rotated.

In embodiments in which shaft 14 is rotatable about shaft axis A, shaft 14 can be rotated to rotate planetary gear wheels 36 and 38 which in turn rotate tool spindles 16 and 18. Shaft 14 may be rotated either in the same circumferential direction as spindle drum 12 or in an oppositely directed circumferential direction to spindle drum 12. For example, if spindle drum 12 is rotated clockwise around spindle drum axis B, shaft 14 may be rotated either clockwise or anticlockwise around shaft axis A.

Hereinafter, as an example, milling device 10 described in detail above in connection with FIGS. 1 and 2 is compared to a know milling device illustrated in FIG. 9 and already mentioned in the background section of the present disclosure.

Figure 9:
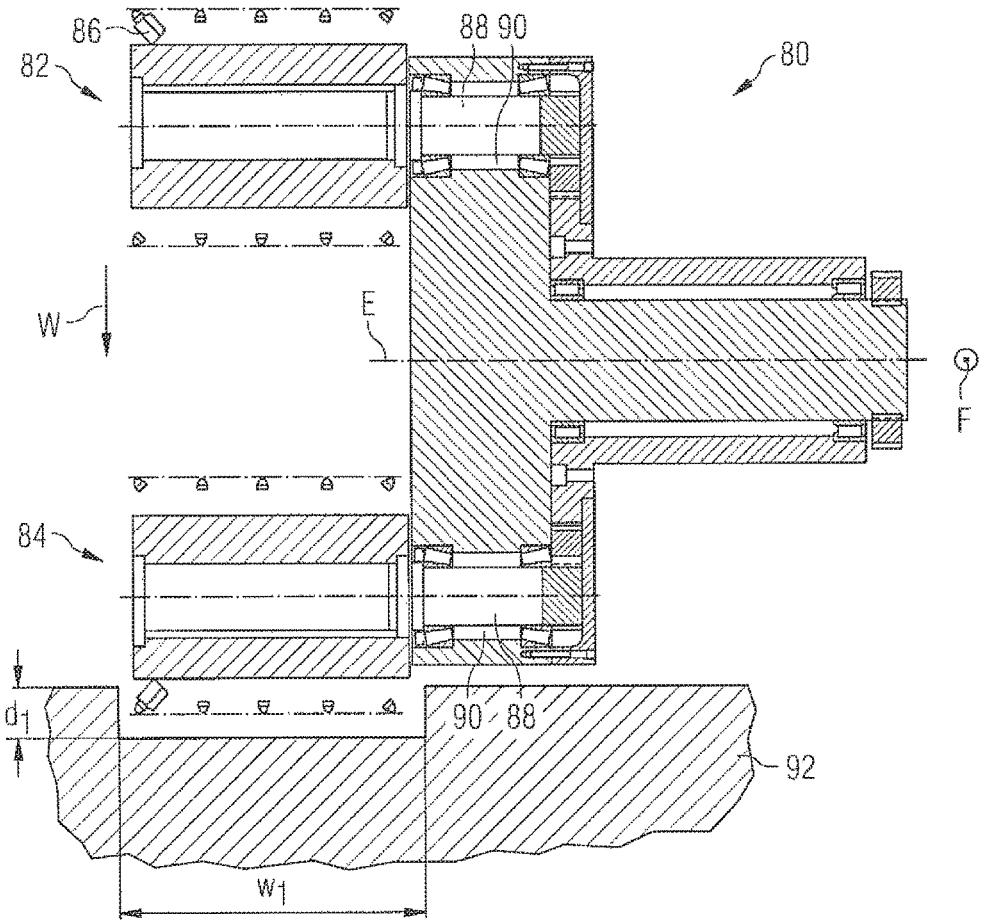
FIG 9 Background Art
FIG. 9 shows a known milling device in an exemplary milling application for comparing to the milling device according to the present disclosure.

Said known milling device 80 illustrated in FIG. 9 comprises two machining tools 82, 84 equipped with a plurality of individual tools 86. Note that both machining tools 82, 84 are positioned overlapping in the direction of a spindle axis E. Tool spindles 88 are rotatably mounted in tool spindle receptions 90 via a back-to-back arrangement of two taper roller bearings.

Figure 10:
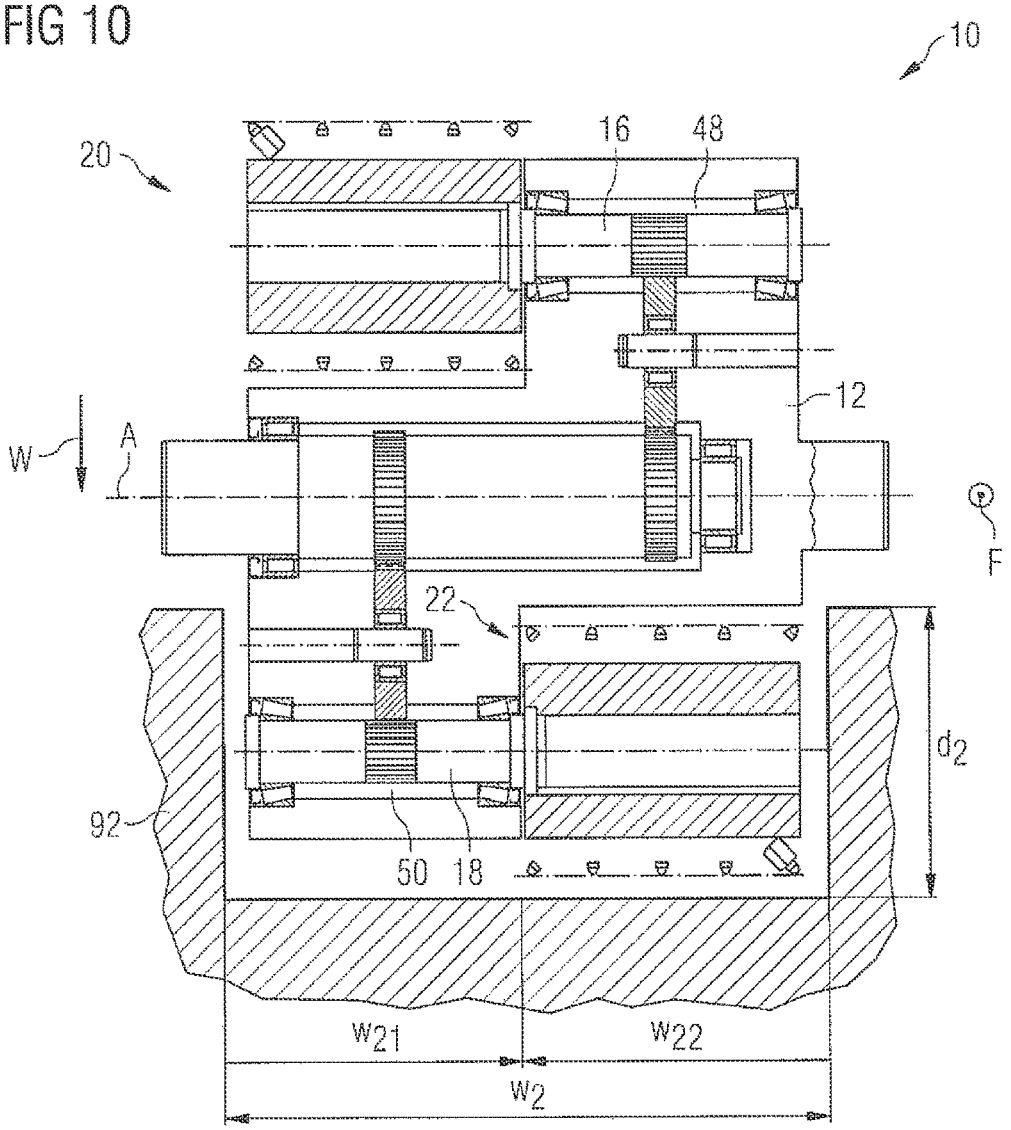
FIG. 10 shows an exemplary milling device according to the present disclosure in an exemplary milling application for comparing to the known milling device depicted in FIG. 9.

In the exemplary milling application shown in FIGS. 9 and 10, the milling device immerses into the material in direction of arrow W until a realizable cutting depth d is reached, and simultaneously or subsequently advances in direction of arrow F to mill material 92 along cutting width w.

Turning first to the realizable cutting depth and width of known milling device 80. Said known milling device 80 provides a comparatively small cutting depth $d_1$ due to the presence of tool spindle receptions 90. Specifically, geometric dimensions of tool spindle receptions 90 strongly limit the depth with which milling device 80 can immerse into material 92 to be milled.

Moreover, a cutting width $w_1$ of known milling device 80 is also comparatively small as both machining tools 82 and 84 cut along the same section. In other words, each machining tool 82, 84 of milling device 80 is positioned overlapping with one another in the direction of shaft axis E.

On the contrary, milling device 10 exemplary disclosed herein provides a comparatively deep cutting depth $d_2$ as a result of the overlapping arrangement of tool spindle receptions 48, 50 and machining tools 20, 22. For example, first machining tool 20 is positioned substantially overlapping with second tool spindle reception 50 in the direction of shaft axis A. Therefore, if rotating spindle drum 12 through 180° about spindle axes B, first machining tool 20 would be located at the former location of second tool spindle reception 50, and vice versa. Thus, machining tool 20 can cut free space required for second tool spindle reception 50 such that milling device 10 can immerse deeper into material 92 to be milled. Likewise, if rotating spindle drum 12 through 180° about spindle axes B, second machining tool 22 would be located at the former location of first tool spindle reception 48 which facilitates cutting free of space required for first tool spindle reception 48 to immerse deeper into the material 92 to be milled.

Additionally, milling device 10 provides a comparatively long cutting width $w_2$ which is a combination of cutting widths $w_{21}$ and $w_{22}$. Specifically, first machining tool 20 cuts material 92 along cutting width $w_{22}$, and second machining tool 22 cuts material 92 along cutting width $w_{22}$. By arranging first machining tool 20 and second machining tool 22 displaced from one another in the direction along shaft axis A, each machining tool 20, 22 cuts with its individual tools along different sections being spaced apart from one another in the direction of shaft axis A.

Note that both milling device 10 and known milling device 80 are equipped with exactly two machining tools and two tool spindles. However, due to the displaced arrangement between tool spindle receptions in the direction of shaft axis A and the displaced arrangement between machining tools in the direction of shaft axis A disclosed herein, milling device 10 can cut deeper cuts and wider cuts compared to milling device 80 in the exemplary shown milling application. Furthermore, milling device 10 has, due to its specific design, the ability to cut free itself.

For example, the milling device exemplary disclosed herein may be applicable in road milling applications, and mining applications. A milling machine which may be configured as, for example, a road mill, a continuous miner, a surface miner, or a shearer loader may comprise milling device 10 for milling coal, concrete, tarmac, and/or other extraction products and materials.

Although the preferred embodiments of this invention have been described herein, improvements and modifications may be incorporated without departing from the scope of the following claims.

The invention claimed is:

1. A milling device, comprising:

a shaft having a shaft axis (A);

a spindle drum rotatably mounted relative to the shaft axis (A) and rotatable about a spindle drum axis (B) that is coaxial with the shaft axis (A);

a plurality of tool spindles, each tool spindle of the plurality of tool spindles being rotatably mounted in the spindle drum and rotatable about a tool spindle axis (D), each tool spindle axis (D) being arranged parallel to and spaced apart from the shaft axis (A) and having a same distance to the shaft axis (A) along a radial direction, the radial direction being transverse to the shaft axis (A), a circumferential location of each tool spindle axis (D) about the shaft axis (A) being different from a circumferential location of any other tool spindle axis (D), each tool spindle extending from a proximal end to a distal end; and a plurality of machining tools, each machining tool of the plurality of machining tools extending from a proximal end to a distal end, each machining tool being carried by a corresponding tool spindle of the plurality of tool spindles, such that the distal end of each tool spindle is disposed further from a corresponding machining tool than the proximal end of a same tool spindle along the tool spindle axis (D), the plurality of machining tools including at least one first machining tool and at least one second machining tool, the at least one first machining tool and the at least one second machining tool being spatially displaced from one another along a direction of the shaft axis (A), such that the proximal end of the at least one first machining tool and the proximal end of the at least one second machining tool are each disposed between the distal end of the at least one first machining tool and the distal end of the at least one second machining tool along the direction of the shaft axis (A), the distal end of the at least one first machining tool and the distal end of the at least one second machining tool facing away from one another along the direction of the shaft axis (A).

2. The milling device of claim 1, wherein the spindle drum defines a plurality of tool spindle receptions that receive the plurality of tool spindles, and the plurality of tool spindle receptions include a at least one first tool spindle reception and at least one second tool spindle reception, the at least one first tool spindle reception being positioned displaced from the at least one second tool spindle reception along the direction of the shaft axis (A).

3. The milling device of claim 2, wherein the at least one first machining tool and the at least one second tool spindle reception are positioned overlapping with one another along the direction of the shaft axis (A), and the at least one second machining tool and the at least one first tool spindle reception are positioned overlapping with one another along the direction of the shaft axis (A).

4. The milling device of claim 1, wherein the at least one first machining tool and the at least one second machining tool are positioned partially overlapping with one another along the direction of the shaft axis (A).

5. The milling device of claim 1, wherein the at least one first machining tool includes at least three first machining tools, and the at least one second machining tool includes at least three second machining tools, neighboring first machining tools of the at least three first machining tools along a circumferential direction around the shaft axis (A) are arranged equidistantly to one another, and neighboring second machining tools of the at least three second machining tools in the circumferential direction are positioned equidistantly to one another.

6. The milling device of claim 1, wherein at least one tool spindle of the plurality of tool spindles carries two machining tools of the plurality of machining tools, one machining tool of the two machining tools being carried at the proximal end of the at least one tool spindle, and another machining tool of the two machining tools being carried at the distal end of the at least one tool spindle.

7. The milling device of claim 1, further comprising a plurality of planetary gear wheels rotatably mounted relative to the spindle drum and being rotatable about planetary gear axes (C) that are arranged parallel to and spaced apart from the shaft axis (A), the plurality of planetary gear wheels being operatively coupled to the plurality of tool spindles to rotatably drive the plurality of tool spindles.

8. The milling device of claim 1, wherein the spindle drum defines a central shaft reception that receives the shaft.

9. The milling device of claim 1, wherein the shaft is rotatable about the shaft axis (A).

10. The milling device of claim 1, wherein each machining tool of the plurality of machining tools comprises a plurality of individual tools.

11. The milling device of claim 1, wherein the milling device is configured to be used in at least one of a road mill, a continuous miner, a surface miner, and a shearer loader.

12. The milling device of claim 1, wherein each machining tool is cantilevered from the proximal end of the corresponding tool spindle.

13. A milling machine, comprising:

a shaft having a shaft axis (A);

a spindle drum rotatably mounted relative to the shaft axis (A) and rotatable about a spindle drum axis (B) that is coaxial with the shaft axis (A);

a plurality of tool spindles, each tool spindle of the plurality of tool spindles being rotatably mounted in the spindle drum and rotatable about a tool spindle axis (D), each tool spindle axis (D) being arranged parallel to and spaced apart from the shaft axis (A) and having a same distance to the shaft axis (A) along a radial direction, the radial direction being transverse to the shaft axis (A), a circumferential location of each tool spindle axis (D) about the shaft axis (A) being different from a circumferential location of any other tool spindle axis (D), each tool spindle extending from a proximal end to a distal end; and a plurality of machining tools, each machining tool of the plurality of machining tools extending from a proximal end to a distal end, each machining tool being carried by a corresponding tool spindle of the plurality of tool spindles, such that the distal end of each tool spindle is disposed further from a corresponding machining tool than the proximal end of a same tool spindle along the tool spindle axis (D), the plurality of machining tools including at least one first machining tool and at least one second machining tool, the at least one first machining tool and the at least one second machining tool being spatially displaced from one another along a direction of the shaft axis (A), such that the proximal end of the at least one first machining tool and the proximal end of the at least one second machining tool are each disposed between the distal end of the at least one first machining tool and the distal end of the at least one second machining tool along the direction of the shaft axis (A), the distal end of the at least one first machining tool and the distal end of the at least one second machining tool facing away from one another along the direction of the shaft axis (A).

14. The milling machine of claim 13, wherein the milling machine is at least one of a road mill, a continuous miner, a surface miner, and a shearer loader.

15. The milling machine of claim 13, wherein the spindle drum defines a plurality of tool spindle receptions that receive the plurality of tool spindles, and the plurality of tool spindle receptions include at least one first tool spindle reception and at least one second tool spindle reception, the at least one first tool spindle reception being positioned displaced from the at least one second tool spindle reception along the direction of the shaft axis (A).

16. The milling machine of claim 15, wherein the at least one first machining tool and the at least one second tool spindle reception are positioned overlapping with one another along the direction of the shaft axis (A), and the at least one second machining tool and the at least one first tool spindle reception are positioned overlapping with one another along the direction of the shaft axis (A).

17. The milling machine of claim 13, wherein the at least one first machining tool and the at least one second machining tool are positioned partially overlapping with one another along the direction of the shaft axis (A).

18. The milling machine of claim 13, further comprising a plurality of planetary gear wheels rotatably mounted relative to the spindle drum and being rotatable about planetary gear axes (C) that are arranged parallel to and spaced apart from the shaft axis (A), the plurality of planetary gear wheels being operatively coupled to the plurality of tool spindles to rotatably drive the plurality of tool spindles.

19. The milling machine of claim 13, wherein each machining tool is cantilevered from the proximal end of the corresponding tool spindle.

* * * * *